US006543136B1

(12) United States Patent
Parish

(10) Patent No.: US 6,543,136 B1
(45) Date of Patent: Apr. 8, 2003

(54) METHOD FOR IMPROVED VALVE SEATING OF A FUEL INJECTOR BY COINING AND A VALVE MADE THEREBY

(75) Inventor: James Robert Parish, Yorktown, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 09/606,409

(22) Filed: Jun. 29, 2000

(51) Int. Cl.[7] ..... B21K 1/24

(52) U.S. Cl. ..... 29/890.124; 29/890.122; 29/888.44; 29/DIG. 46; 72/710

(58) Field of Search ..... 29/888.44, 890.121, 29/890.122, 890.126, 890.132, 402.05, DIG. 46, 90.01, 890.13; 72/710

(56) References Cited

U.S. PATENT DOCUMENTS 2,345,349 A * 3/1944 Martin
4,583,966 A 4/1986 Ocker et al.
5,081,766 A 1/1992 Kellum, Jr. et al.
5,303,509 A 4/1994 Schweizer et al.
5,315,792 A 5/1994 Schweizer et al.
5,699,693 A 12/1997 Nogami et al.
5,890,659 A 4/1999 Schoeffel et al.
5,934,976 A 8/1999 Makino et al.

* cited by examiner

*Primary Examiner*—Irene Cuda-Rosenbaum
*Assistant Examiner*—Eric Compton

(57) ABSTRACT

A method for making a valve assembly is disclosed. The method includes providing a first work piece having a longitudinal axis and a first end and providing a second work piece having a surface. The method also includes disposing the first work piece and the second work piece axially between a pair of aligned elements that are relatively movable toward and away from each other along the longitudinal axis of the first work piece. Additionally, the method includes relatively moving the pair of aligned elements toward each other to axially clamp the first work piece and the second work piece and actuating the pair of aligned elements and delivering to the first work piece and the second work piece a controlled clamping force that acts to coin a zone of surface contact between the first end and the surface. Further, the method includes repeating the actuating of the pair of elements a plurality of times. An apparatus used to perform the method is also disclosed.

13 Claims, 2 Drawing Sheets

METHOD FOR IMPROVED VALVE SEATING OF A FUEL INJECTOR BY COINING AND A VALVE MADE THEREBY

FIELD OF THE INVENTION

The present invention relates to a method and apparatus used to coin a valve seat in a fuel injector to improve seating between the valve seat and a needle in the injector.

BACKGROUND OF THE INVENTION

The metal-to-metal seal formed in a valve between a needle and a seat determines the accuracy at which the fluid flowing through the valve is controlled. Leakage results when the surfaces between the needle and the seat do not mate correctly. This leakage, no matter how small, is detrimental in systems where precise flow control is desired.

One of the uses of a fluid valve of the type to which the present invention relates is as a fuel injector for injecting a combustible fuel into a combustion engine. In the case of a spark-ignited, internal combustion engine for an automotive vehicle, the valve is typically under the control of an electronic control system and injects gasoline into the engine.

One of the chief reasons for using a fuel-injected engine is because of the ability to closely control the amount of fuel entering the engine. Close control over injected fuel is important for reasons of both fuel economy and exhaust emissions. When a fuel injector is closed, it should totally prevent fuel from leaking into the engine because such leakage can have undesired consequences. For example, even small amounts of leakage can adversely affect exhaust emissions in very significant ways. Certain countries now impose limits on the amounts of certain exhaust constituents that can be discharged to the atmosphere, and there is a trend toward making these limits even stricter. Accordingly, a commercially acceptable fuel injector is likely to have to comply with increasingly stringent limits on leakage.

The method and apparatus used to manufacture the needle and the seat greatly influence the accuracy and reliability of the fluid valve. Extremely costly manufacturing procedures could, of course, be invoked to ensure precise surface finishes and fits of the cooperating needle and seat by placing extremely small tolerances on the dimensions and surface finishes of the parts involved. Such activities would obviously increase the manufacturing costs, possibly to non-competitive prices for some companies. Alternate procedures that are less costly are therefore desirable.

One known method for surface finishing the needle and seat involves a grinding process. The mating surfaces of the needle and the seat are pressed into contact. Then, either the needle or the seat is rotated relative to the other. This grinding of the mating surfaces of the needle and the seat is performed in the presence of a slurry of fine-grained lapping medium. Vibrating the needle and the seat in the axial direction of the needle valve further complicates this known process. The vibration of these two valve elements is performed at the same frequency but at a different amplitude to impart a pumping action on the slurry.

Another method for manufacturing the needle and seat applies an axial compressive load to force the needle against the seat, coining the needle to the seat. The method described in U.S. Pat. No. 5,081,766 produces a valve that is capable of accurate and reliable fluid metering yet avoids expensive tolerance control on surface finishing and part dimensioning. The method disclosed by this patent involves the inclusion of an additional step in the manufacturing process, the coining step, but eliminates the necessity for stricter tolerances on surface finish and part dimensions. Accordingly, reconfiguration of existing manufacturing equipment and processes requires merely adding the coining step to reduce leakage through the injector. This coining step however does not involve the use of a coining die to coin a part. Rather, the coining step involves the application of axial compressive load to force a rounded distal end of the needle against a frusto-conical surface of the seat so that coining action occurs at an annular zone of surface contact between the needle and the seat. The force application is preferably conducted in a particular manner so that the needle is neither irreversibly bent nor buckled by the coining step. This step is conducted during the manufacturing process so that neither the solenoid nor the spring, which are parts of the operating mechanism in the completed injector, has an influence on the result of the coining.

Known manufacturing equipment typically comprises a fluid powered piston device to apply the axial compressive load. However, the compressive load is applied only one time during the manufacturing of the injector. If the needle and seat are laterally or rotationally displaced from one another after coining, the coining effect may be lost. It would be beneficial to develop a method of applying the compressive load multiple times during the manufacturing of the injector to form a better seal between the needle and the seat.

BRIEF SUMMARY OF THE INVENTION

Briefly, a method for making a valve assembly is provided. The method comprises providing a first work piece having a longitudinal axis and a first end and providing a second work piece having a surface. The method also comprises the first work piece and the second work piece axially between a pair of aligned elements that are relatively movable toward and away from each other along the longitudinal axis of the first work piece. Additionally, the method comprises relatively moving the pair of aligned elements toward each other to axially clamp the first work piece and the second work piece and actuating the pair of aligned elements and delivering to the first work piece and the second work piece a controlled clamping force that acts to coin a zone of surface contact between the first end and the surface. Further, the method comprises repeating the actuating of the pair of elements a plurality of times.

Additionally, the present invention provides a coining apparatus. The coining apparatus comprises a frame, a first clamp having a first work piece receiving portion, and a second clamp axially aligned with and opposing the first clamp. The second clamp has a second work piece receiving portion. One of the first clamp and the second clamp is connected to the frame. The coining apparatus also comprises a vibrator attached to the frame, distal from the one of the first clamp and the second clamp connected to the frame and a cylinder connecting the vibrator and the other of the first clamp and the second clamp. The cylinder includes a rod reciprocally extending therefrom. The rod is connected to one of the vibrator and the other of the first clamp and the second clamp.

BRIEF DESCRIPTION OF THE DRAWINGS

The accompanying drawings, which are incorporated herein and constitute part of this specification, illustrate the presently preferred embodiment of the invention, and, together with the general description given above and the detailed description given below, serve to explain features of the invention. In the drawings.

DETAILED DESCRIPTION OF THE PREFERRED EMBODIMENT

Figure 1:
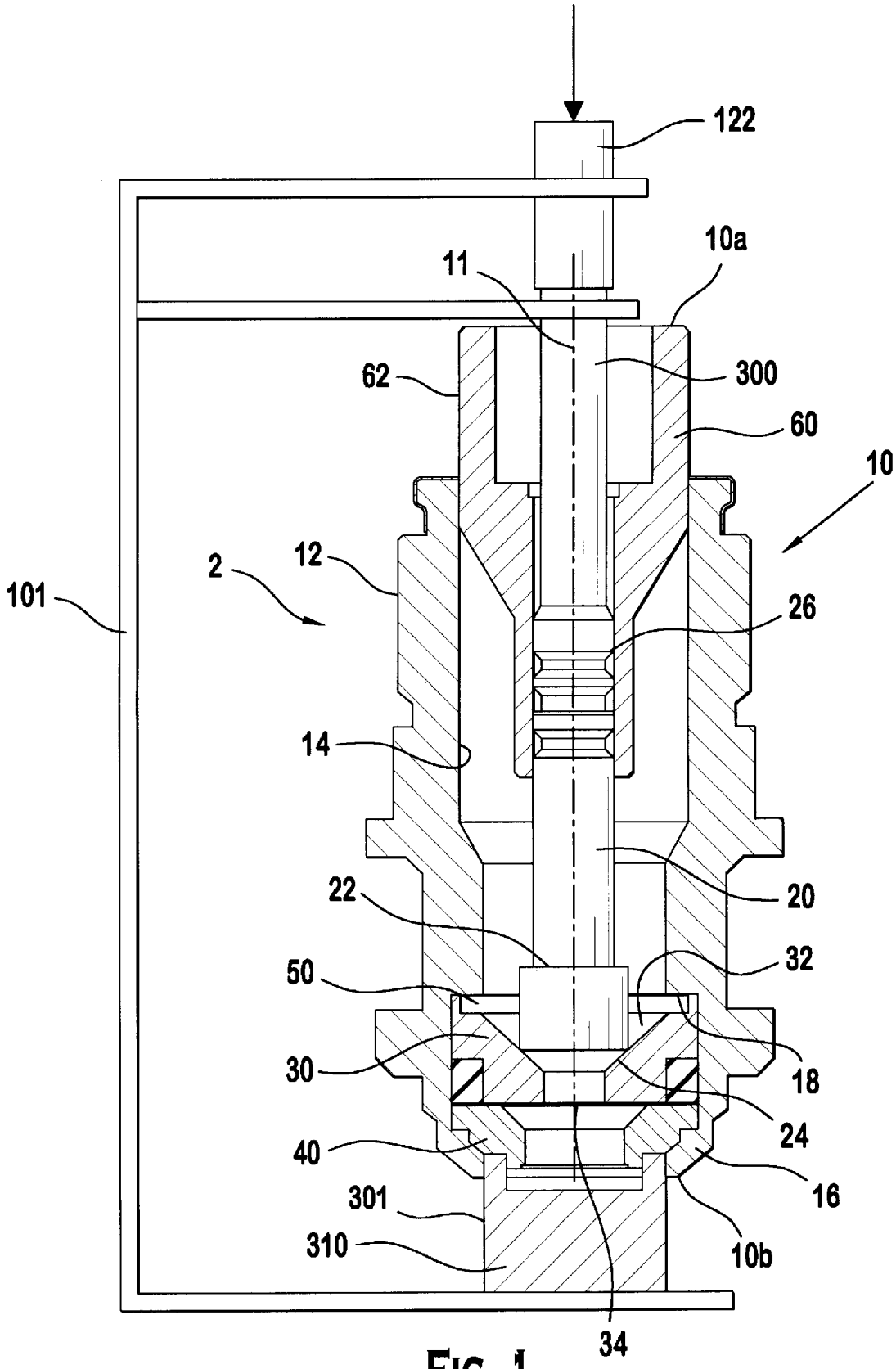
FIG. 1 is a partial view taken in cross-section of a valve mounted on a coining apparatus during the manufacturing process.

FIG. 1 illustrates a fluid valve assembly 10 having an upstream end 10*a,* a downstream end 10*b,* a longitudinal axis 11 extending therethrough, a valve body 12 housing an elongated needle 20 and an annular valve seat 30. As used herein, the terms "upstream" and "downstream" refer to directions toward the top and bottom of FIG. 1, respectively. In the drawings, like numbers indicate like elements throughout. The valve body 12 has a hollow portion defined by an inner surface 14. The needle 20 and the seat 30 are coaxially received along the longitudinal axis 11 in the hollow portion of the valve body 12. Although the fluid valve assembly 10 is preferably part of a fuel injector and a fluid used in the fluid valve assembly 10 is preferably a fuel, such as gasoline, those skilled in the art will recognize that the fluid valve assembly 10 can be other than a fuel injector and the fluid can be other than a fuel.

An annular element 40 is interposed with the seat 30 and a first annular shoulder 16 of the valve body 12. A valve guide 50 is secured between the seat 30 and a second shoulder 18 formed on the inner surface 14. The valve guide 50 has a central hole through which the needle 20 extends. Fluid can exit the valve assembly 10 via an orifice 34 in the seat 30.

The seat 30 includes a generally frusto-conical surface 32, which extends generally downstream and toward the longitudinal axis 11. The seat 30 also includes an orifice 34 at the downstream end of the frusto-conical surface 32 and along the longitudinal axis 11. Preferably, the seat 30 is constructed from a metal, such as stainless steel. A downstream end 22 of the needle 20 has a convex surface 24 that engages the frusto-conical surface 32 of the seat 30 when the needle 20 is in a closed position. Also preferably, the needle 20 is constructed from a metal, such as stainless steel. An armature 60 is connected to an upstream end 26 of the needle 20. The armature 60 has an outer surface 62 that slidably engages a portion of the inner surface 14 during operation of the fluid valve assembly 10.

During operation of the fluid valve assembly 10, the needle 20 is axially reciprocally displaced toward and away from the seat 30. Contact between the convex surface 24 and the frusto-conical surface 32 forms a seal to block the flow of fluid through the orifice 34. The effectiveness of this seal is determined by the tightness of the contact between the convex surface 24 and the frusto-conical surface 32. Surface irregularities and misalignment between the convex surface 24 and the frusto-conical surface 32 have adverse effects on the contact tightness, especially where the contact is metal-to-metal.

When the completed fluid valve assembly 10 is in use, pressurized liquid fuel that has been introduced into the upstream end of the injector fills the annular space surrounding the needle 20 within the body 12. Circumferentially spaced through-holes (not shown) in the valve guide 50 serve to convey the fuel from the annular space to fill depression defined by the frusto-conical surface 32 with pressurized fuel in a conventional manner.

FIG. 1 illustrates the seated condition wherein the convex surface 24 of the needle 20 has an annular zone of sealing contact with the frusto-conical surface 32 to thereby close orifice 34, and hence prevent pressurized fuel from being emitted from the fluid valve assembly 10. This condition represents the closed condition of the fluid valve assembly 10.

It is in this closed condition that the convex surface 24 and the frusto-conical surface 32 are coined together according to the method of the present invention. The coining is conducted at a station 2 of the assembly line on which the injectors are assembled. FIG. 1 represents the fluid valve assembly 10 at the station 2. Essentially the station 2 comprises a suitable fixture 301 for supporting that much of the fluid valve assembly 10 as is portrayed, preferably in an upright orientation. The station 2 has a mechanism, which is capable of axially clamping the needle 20 and the seat 30 in such a manner that an axial compressive load can be applied to the needle 20 and the seat 30 in a controlled manner.

FIG. 1 illustrates two elements of the station's mechanism, a first clamp 300 and a second clamp 310. The clamps 300, 310 are arranged coaxially along the longitudinal axis 11 and so that the parts to be clamped, the needle 20 and the seat 30, can be placed coaxially between the clamps 300, 310. The clamps 300, 310 are then relatively moved toward each other along the longitudinal axis 11 so that clamping occurs in the manner presented in FIG. 1. In this regard first annular shoulder 16 circumscribes an opening sufficiently large to allow for through-passage of the upstream end of second clamp 310 into abutment with the annular element 40. The armature 60 allows the downstream end of the first clamp 300 to abut the upstream end 26 of the needle 20. Preferably the abutment surfaces for the parts involved are flat and smooth, as shown.

Figure 2:
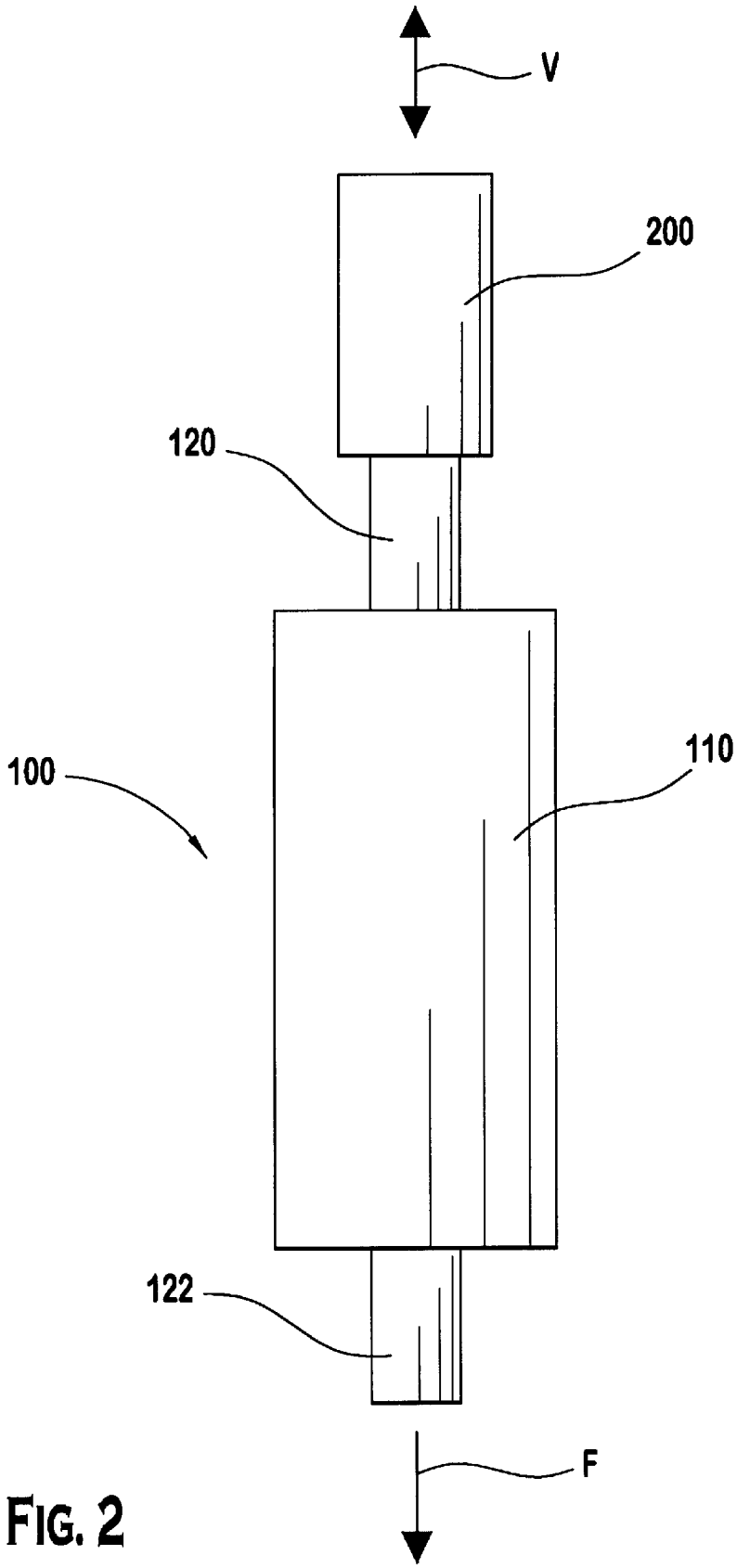
FIG. 2 is a schematic of the preferred embodiment of the coining apparatus.

FIG. 2 shows, schematically, an apparatus according to the instant invention used to coin the convex surface 24 and the frusto-conical surface 32. A piston assembly 100 has a cylinder 110 in which a piston (not shown) reciprocates in a known manner. Two rods 120, 122 are attached to the piston and extend out of the cylinder 110 in opposite directions. The piston assembly 100 may be any known pneumatic or hydraulic piston assembly that will provide sufficient load to coin the convex surface 24 and the frusto-conical surface 32 together. The piston assembly 100 is secured to a frame 101 in any known manner.

A vibrator 200 is connected to one of the rods 120, 122. Alternatively, the vibrator 200 may be interposed with the rod 122 and the first clamp 300 or placed in contact with the second clamp 310. The vibrator 200 is preferably any known mechanical vibrator, but electro-mechanical vibrators, such as a piezoelectric device or a magnetostrictive device, are equally acceptable. The vibrator 200 in the preferred embodiment operates at a frequency of 50 Hz, but other frequencies are possible.

The valve assembly 10 is secured between the two clamps 300, 310. These clamps 300, 310 are mounted to the frame 101 in a known manner to permit movement relative to each other and to the frame 101. As shown in FIG. 1, the first clamp 300 has one portion that contacts one end 26 of the needle 20 and another portion that contacts the rod 122. The second clamp 310 has a portion that engages the annular element 40.

The needle 20, the seat 30 and annular element 40 become work pieces once the clamps 300, 310 secure them. Coaxial alignment of the needle 20 relative to the seat 30 and the valve body 10 is maintained by the cooperation between the inner surface 14 of the housing 12, the outer surface 62 of the armature 60, the needle 20 and the valve guide 50. Therefore, no external guides are needed to maintain proper alignment of the needle 20, the seat 30 and annular element 40 during the coining operation.

To coin the convex surface 24 and the frusto-conical surface 32, the piston assembly 100 is actuated such that the rod 122 is displaced in a direction F to transmit an axially compressive coining force onto the convex surface 24 and the frusto-conical surface 32. This force is applied for a predetermined amount of time and then released. Simultaneous to the application of the force F, the vibrator 200 is actuated. The vibrator 200 displaces the rod 120 in a reciprocating, vibrating manner as indicated by arrow V in FIG. 2. The vibration of the rod 120 is transmitted to the needle 20 via the piston, the rod 122 and the first clamp 300. This vibration has the effect of applying the coining force to the surfaces 24, 32 multiple times. The conformance of the convex surface 24 and the frusto-conical surface 32, one to the other, increases with each such application of the force. The guidance of the needle 20 and the manner in which the coining force is applied avoids irreversible bending or buckling of the needle 20.

The process that has just been conducted on the fluid valve assembly 10 coins the annular zone of sealing contact between the convex surface 24 of the seated needle 20 and the frusto-conical surface 32. By way of example, the needle 20 and the seat 30 should have approximately the same hardness, Rockwell C 56–60, and that of clamps 300, 310 should be at least that hard, Rockwell C 58–60 for example. The force that is applied should not irreversibly bend or buckle the needle 20. For a needle 20 having a length of 28–30 mm, a diameter of 2 mm and a radius of 1.18–1.32 mm for the downstream end 22, a maximum force of about 490 pounds has been successfully used.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined in the appended claims.

What is claimed is:

1. A method for making a valve assembly comprising:

receiving an elongate first workpiece through a first end of the passage of a body extending along a longitudinal axis and second and third workpieces through the second end of the passage, the second work piece having a surface;

disposing the first, second and third work pieces axially between a pair of aligned elements that are adapted to be relatively movable toward and away from each other with respect to the body and along the longitudinal axis, the third work piece being disposed directly against the second work piece;

increasing a clamping force being applied to the pair of aligned elements toward each other so that the clamping force acts to coin a zone of surface contact between the first end and the surface, the clamping of the pair of aligned elements including bearing one of the pair of aligned elements directly against the third work piece;

vibrating the pair of aligned elements during the increasing of the clamping force while the first workpiece remains stationary in a radial direction with respect to the longitudinal axis; and releasing the clamping force after a period of time.

2. The method of claim 1 further comprising using a vibrator for the repeating of the actuating of the pair of elements.

3. The method of claim 2 wherein the vibrator is a mechanical vibrator.

4. The method of claim 3 wherein the mechanical vibrator is a pneumatic vibrator.

5. The method of claim 2 wherein the vibrator is an electro-mechanical vibrator.

6. The method of claim 5 wherein the electro-mechanical vibrator is a piezoelectric vibrator.

7. The method of claim 5 wherein the electro-mechanical vibrator is a magnetostrictive vibrator.

8. The method of claim 1 wherein the actuating of the pair of aligned elements includes bearing one of the pair of aligned elements directly against an end of the first work piece that is opposite the first end of the first work piece.

9. The method of claim 1, wherein:

the increasing of the clamping force being applied to the pair of aligned elements includes bearing one of the pair of aligned elements directly against an end of the first work piece that is opposite the first end of the first work piece and bearing the other of the pair of aligned elements directly against the third work piece.

10. The method of claim 1, wherein the valve assembly made by the method is part of a fuel injector.

11. The method of claim 10 wherein the first work piece is a needle and a seat is interposed between the needle and the second work piece.

12. The method of claim 1, wherein the increasing comprises increasing the clamping force to 490 pound-force or less.

13. The method of claim 1, wherein the vibrating comprises vibrating the pair of aligned elements at a frequency of approximately 50 Hz.

* * * * *